US009923303B2

(12) United States Patent
Nuetzel et al.

(10) Patent No.: US 9,923,303 B2
(45) Date of Patent: Mar. 20, 2018

(54) ELECTRICAL CONNECTOR WITH TERMINAL CENTERING SYSTEM

(71) Applicant: Delphi International Operations Luxembourg S.A.R.L, Bascharage (LU)

(72) Inventors: Peter Nuetzel, Oberasbach (DE); Vincent Regnier, Spardorf (DE); Michael Gunreben, Schwanstetten (DE)

(73) Assignee: DELPHI TECHNOLOGIES, INC., Troy, MI (US)

( * ) Notice: Subject to any disclaimer, the term of this patent is extended or adjusted under 35 U.S.C. 154(b) by 0 days.

(21) Appl. No.: 15/459,193

(22) Filed: Mar. 15, 2017

(65) Prior Publication Data

US 2017/0310045 A1 Oct. 26, 2017

(30) Foreign Application Priority Data

Apr. 25, 2016 (EP) ..... 16166846

(51) Int. Cl.

| | |
|---|---|
| ***H01R 13/41*** | (2006.01) |
| ***H01R 13/627*** | (2006.01) |
| ***H01R 13/11*** | (2006.01) |
| *H01R 13/24* | (2006.01) |
| *H01R 24/54* | (2011.01) |

(52) U.S. Cl.

CPC ..... *H01R 13/6278* (2013.01); *H01R 13/111* (2013.01); *H01R 13/112* (2013.01); *H01R 13/41* (2013.01); *H01R 13/2442* (2013.01); *H01R 24/545* (2013.01); *H01R 2201/26* (2013.01)

(58) Field of Classification Search

CPC ..... H01R 24/545; H01R 13/41
USPC ..... 439/352, 902, 582, 188, 354, 733.1
See application file for complete search history.

(56) References Cited

U.S. PATENT DOCUMENTS

| | | | | |
|---|---|---|---|---|
| 4,293,181 A | 10/1981 | Lacaze | | |
| 5,489,221 A * | 2/1996 | Fujiura | H01R 13/41 | 439/733.1 |
| 7,207,839 B1 * | 4/2007 | Shelly | H01R 4/2404 | 439/585 |
| 8,430,696 B2 * | 4/2013 | Matsumoto | H01R 13/426 | 439/271 |
| 8,636,522 B2 * | 1/2014 | Sykes | H01R 9/0515 | 439/63 |

(Continued)

FOREIGN PATENT DOCUMENTS

| | | |
|---|---|---|
| EP | 2209167 A1 | 7/2010 |
| EP | 2448066 A1 | 5/2012 |
| WO | 2013034286 A1 | 3/2013 |

*Primary Examiner* — Abdullah Riyami
*Assistant Examiner* — Justin Kratt
(74) *Attorney, Agent, or Firm* — Robert J. Myers

(57) ABSTRACT

An electrical connector configured to be mated with a corresponding counter connector to establish an electrical connection is presented. The connector includes a connector housing having at least one terminal cavity for receiving at least one female contact terminal. The cavity defines a first cavity portion and a second cavity portion. A step is arranged between the first and the second cavity portion. A female contact terminal likewise comprises a step arranged between first and second terminal portions such that, in a mounted condition, the respective steps of terminal cavity and female contact terminal engage each other.

16 Claims, 5 Drawing Sheets

(56) References Cited

U.S. PATENT DOCUMENTS

| | | | | |
|---|---|---|---|---|
| 8,647,128 | B2 * | 2/2014 | Sykes ..... | H01R 24/44<br>439/578 |
| 2004/0166715 | A1 | 8/2004 | Parrish et al. | |
| 2009/0197479 | A1 | 8/2009 | Glick et al. | |

* cited by examiner

ELECTRICAL CONNECTOR WITH TERMINAL CENTERING SYSTEM

CROSS-REFERENCE TO RELATED APPLICATION

This application claims the benefit under 35 U.S.C. § 119(a) of Patent Application No. 16166846.2 filed in the European Patent Office on Apr. 25, 2016, the entire disclosure of which is hereby incorporated by reference.

TECHNICAL FIELD OF THE INVENTION

The present application relates to an electrical connector and in particular to a female terminal holder in a Supplemental Restraint System (SRS) connector.

BACKGROUND OF THE INVENTION

Electrical connector systems are used for joining electrical circuits, wherein typically a male contact terminal is mated with a female contact terminal. In many applications a safe and particularly reliable coupling of contact terminals is of high importance. Especially in motor vehicles, where multiple electrically driven Supplemental Restraint Systems, commonly referred to as airbag systems, are needed to ensure an optimal interplay of safety components (e.g. between the airbag and the pre-tensioner of the safety belt) in an event of an accident.

US Patent Application Publication US 2004/0166715 A1 describes a typical squib connector arrangement as it is used in airbag systems. The squib contains explosive material that is detonated upon receipt of an electrical signal to cause the rapid release of high pressure gas to inflate the airbag. The arrangement comprises typically a socket assigned to the squib and a plug connector. The socket comprises two male terminals, namely pins, which come in electrical contact with the female terminals of the plug connector, when the same is plugged into the socket. In the arrangement disclosed in US '715 also a shorting clip is assigned to the socket, which is biased into electrical contact with the two pins to reduce the risk of misfiring by static electricity, for example during disassembly. The plug connector urges the shorting clip out of the electrical contact with the pins, when the plug connector is plugged into the socket. The connector further comprises a housing with a latch beam that is deflectable between a latched state and an unlatched state and a CPA (Connector Position Assurance) member mounted to the housing is movable between open and closed positions to provide a secondary lock and a visual verification of the correctly mated state.

As can be seen in FIG. 3 of US '715, cavities are provided in the housing. They are usually produced such that they follow the shape of uniform cylinders, with the purpose to house the female terminal leads, which have the task to establish a connection with the male terminals (pins).

These female terminals are usually produced from an "endless" plain strand of conductive material, e.g. metal. During terminal production, the strand is pierced and bend to its final shape and finally cut into smaller pieces to achieve the desired single terminal units. The terminals are usually bend in a way, that they comprise an upper portion having a cylindrical shape with a circular cross section. Also they are provided with springs, which are able to grab the male terminals and thus establish an electrical connection. A front view of such a terminal is depicted in FIG. 12 of US '715. The cylindrical part of the terminal is housed inside a corresponding cavity. For the simplification of production of the housing and to facilitate the assembly, cavities usually follow the cross sectional shape of the terminal, so that the terminals are able to fit tightly into the cavities.

The fixation of a terminal inside a cavity is usually caused by friction between the cylindrical shaped upper portion of the terminal (compare FIG. 11 of US '715) and the inner walls of the cavity. The abovementioned springs usually do not contribute to the fixation of the terminal since they need to be flexibly bendable in- and outwards so that they can grab the male terminals. Hence, quality of fixation is dependent on the upper part, more specifically on the frictional force between the inner walls of the cavity and the outer surface of the terminal cylinder.

This force can be increased for example by an increase in length of the cylindrical shaped part of the terminal, which is in contact with the inner walls of the cavity. When this so called "guiding length" is increased, fixation of the terminal inside the cavity is increased. A proper fixation of the terminal in turn ensures a proper guiding of the male pins into the female terminal during the mating process. If this proper fixation is not given, the terminal could possibly move to a certain degree inside the cavity, resulting in a non-proper established connection. Movement of the terminals can also be caused by pulling the cable that is connected to the connector. The shorter the "guiding length" is and the longer the spring arms are, the larger is the resulting lever effect, causing an alteration of the position of the contact point, where the male pin contacts the female terminal.

The design of such connectors is highly dependent on the desired place of installation. In motor vehicles, the connectors are widely used in supplemental restraint systems, like for example in airbag systems. Especially the installation of the electrical parts in certain armatures, for example in the steering wheel, is highly space constrained, so all parts have to be designed as less space consuming as possible.

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

BRIEF SUMMARY OF THE INVENTION

It is an objective of the present invention to provide an electrical connector with a compact and space saving design, while maintaining its reliability of functionality.

The present invention relates to an electrical connector configured to be mated with a corresponding counter connector to establish an electrical connection. The connector comprises a connector housing, which comprises at least one terminal cavity for receiving at least one female contact terminal. The terminal cavity defines a first cavity portion and a second cavity portion, both extending coaxially and in mating direction, whereby a step is arranged between the first and the second cavity portion. The electrical connector also comprises a female contact terminal, comprising a first terminal portion, configured to fit into the first cavity portion and a second terminal portion, whereby a step is arranged between the first and the second terminal portions, such that in mounted condition, the respective steps of terminal cavity and female contact terminal engage each other.

The electrical connectors presented herein fulfills the need of meeting highly constraint space requirements, e.g. for airbag systems in steering wheels, while ensuring the functionality. They can comprise a housing made of insulative material such as plastic to protect the housed conducting parts, such as contact terminals. The housing can e.g. comprise a top and a bottom part and both parts can be produced in a one-piece design by molding, respectively. The housing, in particular the bottom part can include one or more cavities to house the terminals. Usually the cavities comprise a cylindrical design extending almost fully through the housing from its top to its bottom side along the mating direction. As already discussed, the cavity length depends on the purpose to properly house a respective terminal. Thus, the size of the housing in mating direction is dependent on the cavity length and the corresponding terminal length.

The cavity and terminal design described herein allows to reduce the necessary cavity length. Due to the inventive design, for example, the first cavity portion can be provided with a reduced length in mating direction, while nevertheless a proper fixation of the terminal inside the cavity can be achieved. While the length of the second cavity portion is often dependent and limited by the male counterpart of the counter connector (i.e. male contact pins), redesigning the first cavity portion can lead to a reduced size of the whole electrical connector. An additional feature of the presented design is that the contact point, where the pins come in contact with the terminal inside the cavity, can be arranged close to the mounting end of the terminal. The presented cavity design also allows to overcome the typical space constraints regarding the diameters of the cavity, since the diameters of both, first and second cavity portions can be adjusted independently, as required.

In a preferred embodiment, the first and/or second cavity portion is/are essentially cylindrical. Cylindrical in this context can mean any kind of cylindrical shape with any kind of suitable cross section, i.e. square, rectangular, oval etc. In a particular preferred embodiment, the cross section is however circular. The cavity serves to receive the terminals, while the first and/or the second terminal portion is/are essentially cylindrical as they are supposed to fit into the cavities.

In another preferred embodiment the first terminal portion is arranged in the first cavity portion and the respective steps prevent a movement of the terminal in mating direction. This mechanical stabilization of the terminal is in particular advantageous to constrict movement of the terminal during unmating of the connectors. Also, the steps can facilitate the assembly of the terminal with the cavity as they define a predetermined stop position in mating direction, up to which the terminal can be inserted. Prior art cavities are designed without step so that terminals are at risk of being inserted too far into the cavity during assembly.

In another preferred embodiment the mechanical stabilization of the terminal inside the cavity is further improved and any unwanted movement during assembly is reduced, since the inner walls of the terminal cavity can comprise at least one protruding rib, preferably at least three ribs, extending parallel to the mating direction. Generally, it is preferred that the rib(s) is(are) provided in the first cavity portion. The rib(s) are designed to press against the outer terminal surface for additional fixation of the terminal and to hold the terminal in place for example when forces occur during assembly/disassembly or during the mating/unmating of the connectors that could potentially move the terminal inside the cavity out of its designated position. Preferably, the rib(s) is(are) integrally formed with the inner walls of the terminal cavity, which is of advantage since the complete connector housing can be produced in a one-piece design. This has the additional advantage that the ribs are always placed in the same position inside the cavity. Another advantage is that the production/assembly process of the housing is simplified as it reduces the number of parts that need to be assembled. The amount of ribs required can be varied, as necessary. Also the ribs can be dimensioned and located exactly where they are needed for each type of connector housing. Another advantage is that the ribs are not prone to displacements since they need no additional adherence.

In a preferred embodiment, the rib(s) can extend(s) for at least 50% of the length of the first terminal portion in mating direction, more preferably for at least 75%, even more preferred for at least 80%. The longer the rib(s) is(are) the better is the stabilization/fixation of the terminal inside the cavity. However, preferably, the ribs extend only along the first portion of the cavity. Different lengths of the ribs may be due to different design options of preferred embodiments where not the full length of the first cavity portion needs to be provided with ribs for proper stabilization.

In another preferred embodiment of the invention, a homogenous stabilization/fixation can be achieved when two ribs or more are applied and all ribs have the same distance to their respective neighboring ribs along the circumference of the inner surface of the first cavity portion. Thus, the additional force, which is applied from multiple ribs to the body of the terminal (in particular the first terminal portion) is equally distributed and the terminal is centered such that the extending axis of the cavity and the terminal along mating direction correspond.

In another preferred embodiment, the rib(s) is(are) formed such that the rib(s) clamp the first terminal portion in the first cavity portion in mounted condition. This clamping should be designed that the forces applied to the first terminal portion are on the one hand strong enough to fixate the terminal but on the other hand are not too strong such that the cavity is excessively deformed. Also the terminal shouldn't apply too much back-pressure to the inner surface of the cavity preventing damages of the ribs during assembly or after.

In a further preferred embodiment of the invention, the length of the first cavity portion in mating direction can be less than 100% of the length of the second cavity portion in mating direction, preferably less than 75%, more preferably less than 50%. Accordingly, the terminal can be designed similarly, and the length of the first terminal portion in mating direction can be less than 100% of the length of the second terminal portion in mating direction, preferably less than 75%, more preferably less than 50%. As previously described, a reduction in length of the first cavity portion and thus the length of the first terminal portion allows a reduction of the size of the electrical connector. While improving stability of the terminal inside the cavity by the features described in this invention, the required length for a proper terminal fixation ("guiding length") can be reduced.

The second portion of the terminal can comprise means for engaging a male counterpart (e.g. a corresponding pin). In a preferred embodiment of the invention, the second terminal portion comprises at least two spring arms extending in mating direction, wherein the proximal ends of the spring arms merge with the step of the contact terminal. When a male counterpart (e.g. pin) enters the female terminal, the arms, usually produced from a conductive metal, can flexible bend up to a certain degree in a reversible manner such that they are able to "grab" the male counterpart and guide it to a designated location inside the terminal. In a further preferred embodiment the flexible spring arms comprise a tulip shape at the distal end to facilitate the insertion and/or alignment process. The size and shape of such a tulip is usually chosen such that the spring arms are able to grab and align the entering pins even under bad conditions, e.g. with a very inclined angle. The maximum allowance of such inclined angles can be predefined by pre-alignment means at the mounting end of the cavity portion, which pre-aligns the male pin and only allows certain inclined angles for entering. The skilled person will understand that these alignment means need to be designed in correspondence with the tulip shape to ensure a proper functionality of the spring arms and prevent damage of the spring arms.

According to a preferred embodiment, the female contact terminal is designed to mate with a male pin having a diameter of 0.2 to 3 mm, preferably of 0.3 to 2 mm, more preferably of 0.3 to 1 mm. Those diameters are typical for electrical connector pins used in electrical connectors e.g. in motor vehicles. According to another preferred embodiment, the connector is a SRS connector, as it is currently used for example in airbag systems.

In a beneficial aspect, the terminal cavity portions are cylindrical with a circular cross section, and the diameter of the first cavity portion is larger than the diameter of the second cavity portion, and the step is provided at the position where the two cylindrical portions merge with each other. For this embodiment, it is obvious that the ribs cannot extend into the second portion as they would possibly interfere with the spring arms due to the reduced diameter of the second portion. A circular cross section may be of advantage for a facilitated production (molding) process. Since the bottom housing is usually produced in a one-piece design, same physical material parameters (e.g. rigidity, resistivity) apply for all locations along the inner surface of the cavity, which facilitates the estimation of any potentially impacting effects (e.g. mechanical, electrical) to the connector.

In another beneficial aspect the first terminal portion is cylindrical with a circular cross section, and the second terminal portion comprises at least two spring arms extending in mating direction for engagement with a corresponding male terminal, and the step is provided at the position where the first and second terminal portions merge with each other, such that the steps of the terminal and the corresponding cavity can engage and rest upon each other.

BRIEF DESCRIPTION OF THE SEVERAL VIEWS OF THE DRAWING

The present invention will now be described, by way of example with reference to the accompanying drawings, in which.

DETAILED DESCRIPTION OF THE INVENTION

In the following the present invention will now be described in more detail hereinafter with reference to the accompanying figures, in which non-limiting examples of the invention are illustrated. However, the present invention may be embodied in different forms and should not be construed as limited to the embodiments set forth herein. Rather, these examples are provided so that this disclosure will be thorough and will convey the scope of the invention to persons skilled in the art.

Figure 1:
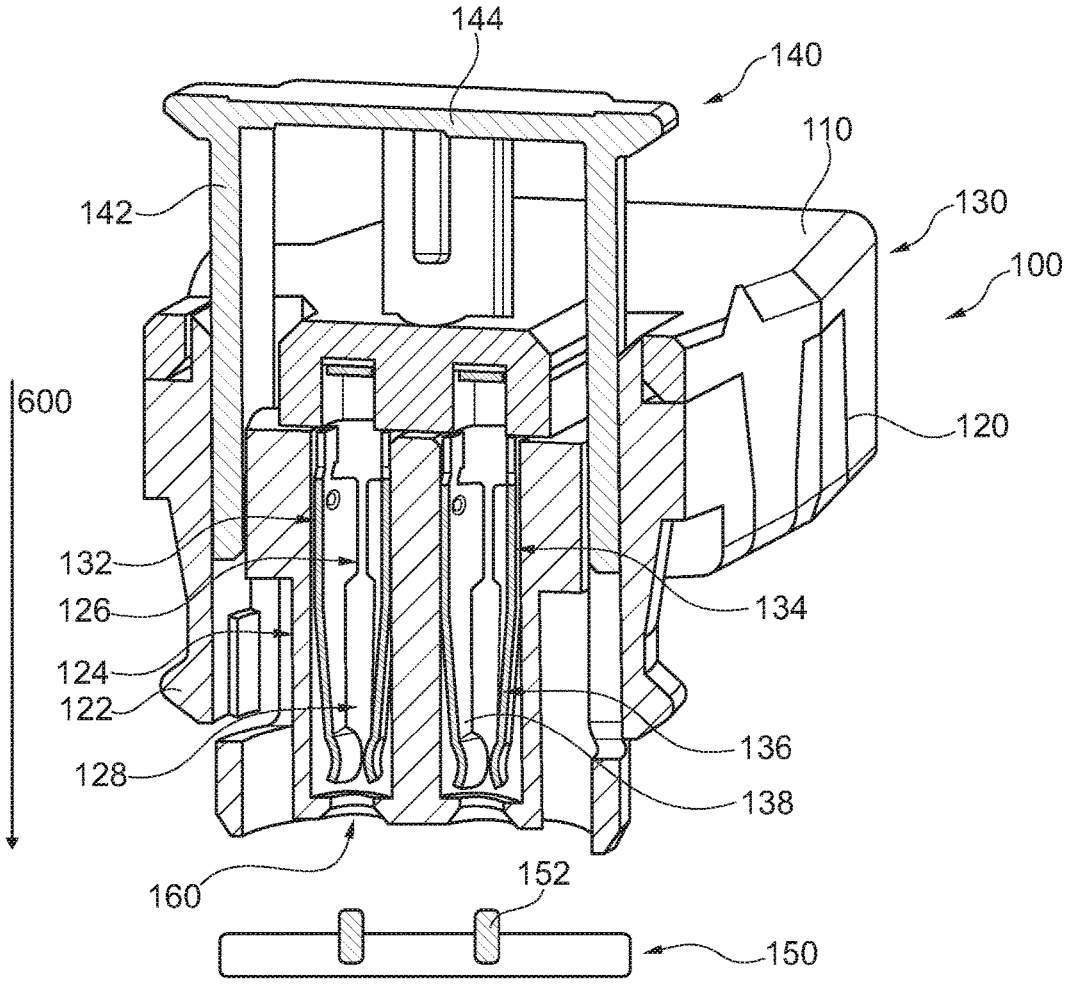
Fig. 1 PRIOR ART
FIG. 1 illustrates an exemplary prior art SRS connector in a sectional view comprising all parts mounted in a "ready-to-be-mated" state according to one embodiment of the invention.

FIG. 1 illustrates a plug connector 100 that represents a typical SRS connector design with a top housing 110 and a bottom housing 120 that are mounted upon each other to form the connector housing 130. Both top housing 110 and the bottom housing 120, are usually composed of an electrically insulative material, such as plastic. The connector housing 130 protects the electrical conducting components inside the connector housing 130 from environmental influences such as moisture or physical damage and allows a mechanical and electrical connection to a corresponding counter connector, i.e. a socket.

The bottom housing 120 comprises bottom housing latches 122 at the mounting end 160. When the plug connector 100 is mated with a counter connector 150 at the mounting end 160, the provided bottom housing latches 122 flexible engage corresponding latches or grooves of the counter connector 150, thereby locking the two connectors with each other. A connector position assurance (CPA) member 140, respectively a secondary locking device, is located on the upper side of the connector housing 130.

The CPA member 140 comprises two CPA arms 142 that are interconnected by an integral web 144. After full mating of the plug connector 100 with the counter connector 150, the CPA member 140 can be pushed downwardly in FIG. 1, so that the CPA arms 142 slide downwards along the mating direction 600. This has the effect that the CPA arms 142 block a further movement of the bottom housing latches 122 and hence lock them. This prevents from any unwanted decoupling of the bottom housing latches 122 and the and hence a decoupling of the plug connector 100 from the counter connector 150.

The bottom housing 120 also comprises cavities 124. Those cavities 124 often comprise a cylindrical shape with a circular cross section as shown, and are divided along mating direction 600 into a top or first cavity portion 126 and a bottom or second cavity portion 128, as seen towards the mounting end 160. Two female terminals 132 are fitted into the cavities 124, which are composed from an electrically conducting material. The female terminals 132 are designed to engage with a male counterpart (e.g. a pin 152) of the counter connector 150 and thus establish an electrical connection. The female terminals 132 can also be distinguished, similarly to the cavities, into a top or first terminal portion 134, which fits in the first cavity portion 126 and a bottom or second terminal portion 136 which fits in the second cavity portion 128. Notably, the quality of fixation of the female terminal 132 is dependent on the "guiding length", which is the length where the outer surface of the first terminal portion 134 is in contact with the inner surface of the first cavity portion 126. The second terminal portion 136 comprises spring arms 138 for grabbing a corresponding male pin 152, which enters the second cavity portion 128 during the mating process, at the mounting end 160, against the mating direction 600, and for guiding it inside the cavity. The second terminal portion 136 is not in contact with the inner walls of the second cavity portion 128. A mechanical fixation of the female terminals 132 is thus only effected by the respective first terminal portions 134 inside the first cavity portion 126.

In FIG. 1, the cavities 124 have a cylindrical shape with the same circular cross-section along the lengths of the cavities. The position of the female terminals 132 along mating direction 600 may thus vary since no other means for safeguarding the terminal's position are provided when the female terminals 132 are brought inside the cavities 124 during the assembly of the plug connector 100. Also no additional stabilization in mating direction 600 is granted when pulling forces occur in mating direction 600, for example during unmating of the plug connector 100 from the counter connector 150.

As depicted in FIG. 1, the "guiding length" of the first terminal portion 134 exhibits around the same length as the spring arms 138 of the second terminal portion 136. A sufficient "guiding length" is needed to ensure a proper stabilization of the female terminals 132 inside the cavities 124 in this prior art design. Therefore, the overall size of the plug connector 100 is relatively large.

Figure 2:
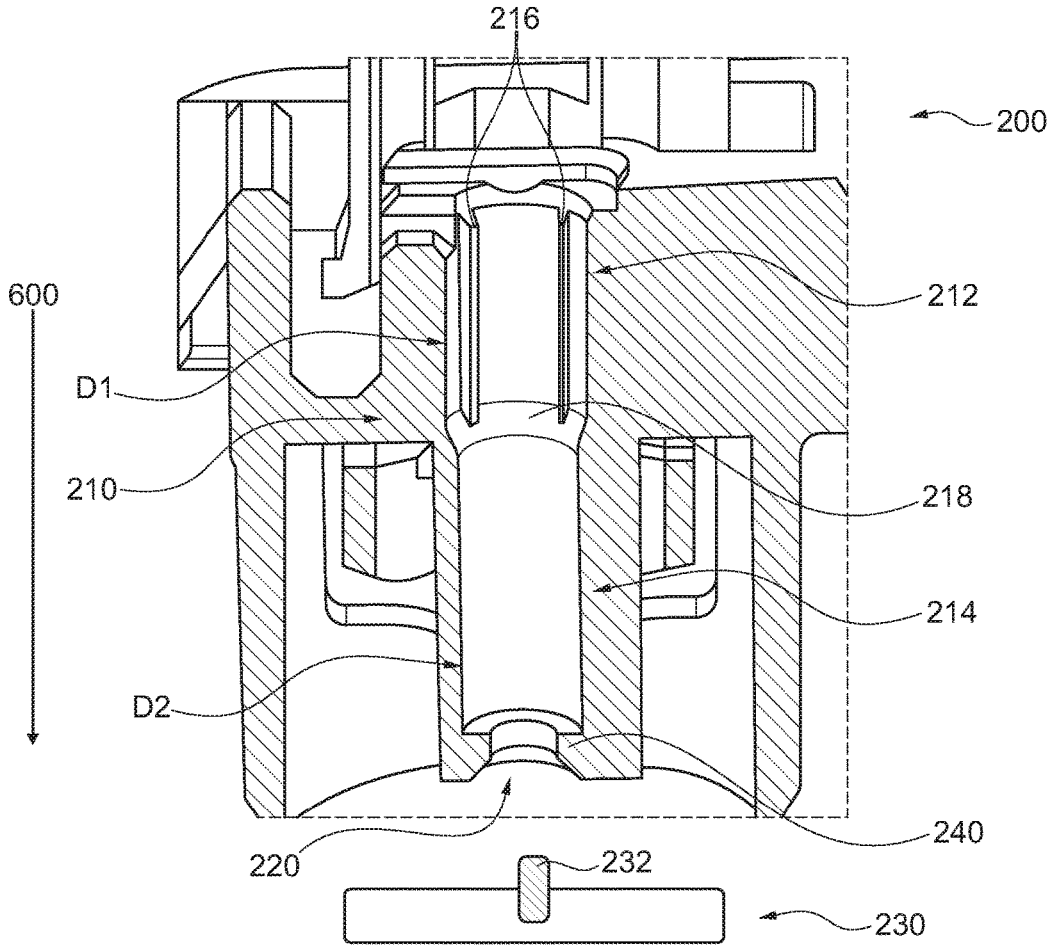
FIG. 2 illustrates a detail of the housing in a sectional view, showing the invented cavity in an un-mounted condition according to one embodiment of the invention.
Figure 3:
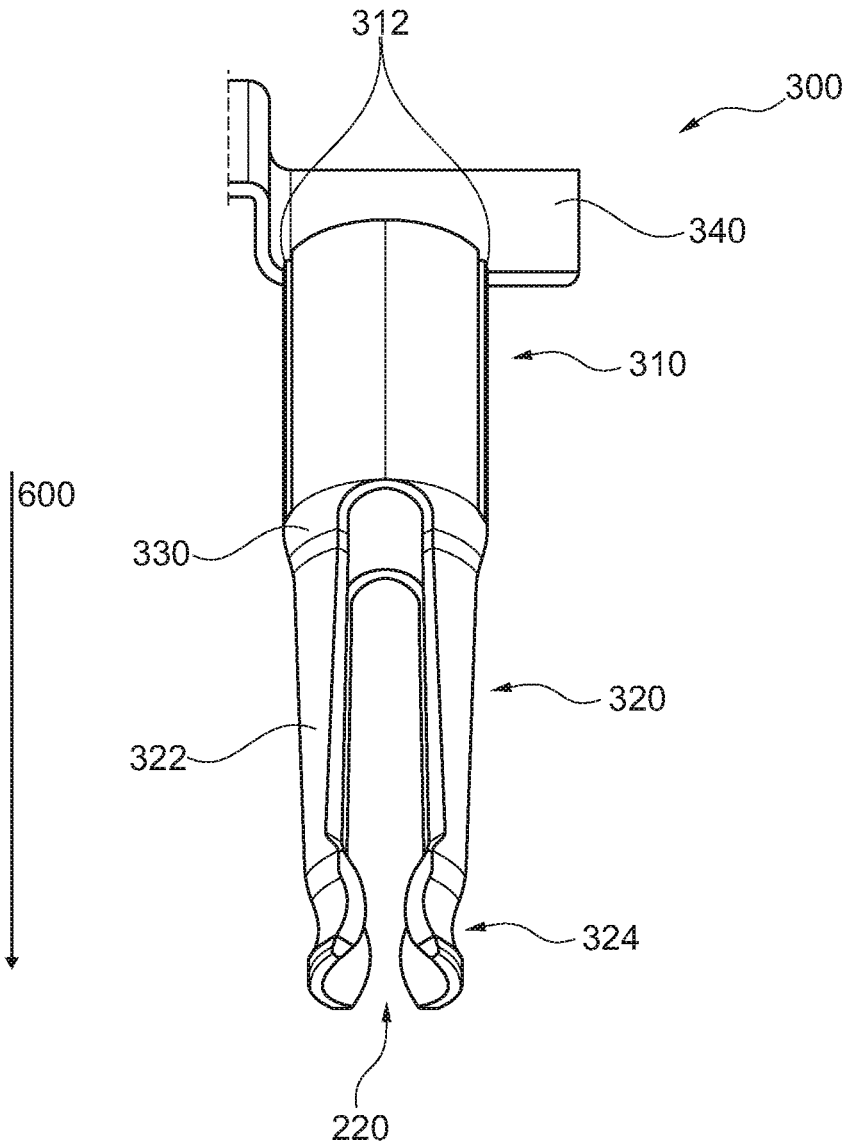
FIG. 3 illustrates the corresponding female contact terminal in a side view according to one embodiment of the invention.

FIG. 2 depicts in a preferred embodiment of the invention a sectional view of a bottom housing 200 in un-mounted condition. The bottom housing 200 can be identical to the bottom housing 120 of FIG. 1 except for the shape of the cavities. Thus, also the bottom housing 200 may comprise locking arms and it can be mounted with the same top housing 110 as shown in FIG. 1. Naturally, the connector housing 130 may also be a single piece or it can be composed of more than two parts. The cavity 210 inside the housing is designed in a way to house a fitting female terminal 300 (as it is shown in FIG. 3). The cavity 210 can be designed in a cylindrical manner, in particular with a circular cross section. As can be seen in FIG. 2, the cavity 210 divides into two portions: a first cavity portion 212 and a second cavity portion 214 which are adjacent to each other. A cavity step 218 is provided between the first 212 and second cavity portions 214 at the position where the two portions merge with each other. At the mounting end 220 an opening is provided, where the male terminal counterpart (e.g. a pin 232) of a corresponding counter connector 230 can enter the cavity 210. For the purpose of pre-alignment of the pins 232, corresponding means 240 are located at the mounting end 220 to pre-determine the angles under which a male pin 232 is able to enter the second cavity portion 214. The design of the terminal allows grabbing and aligning a corresponding male pin 232 of a counter connector 230.

At the inner walls of the first cavity portion 212, protruding ribs 216 are provided. Those ribs are integrally formed with the inner walls of the cavity 210 and extend coaxially from the top of the first cavity portion 212 to the cavity step 218, provided at the bottom of the first cavity portion 212, where the first cavity portion 212 merges with the second cavity portion 214. Thus, the ribs extend for about 100% of the length of the first cavity portion 212 in mating direction 600. In FIG. 2, the diameter D1 of the first cavity portion 212 is larger than the diameter D2 of the second cavity portion 214 and the cavity step 218 is provided where the two cylindrical portions merge with each other. The cavity step 218 serves as a stop member for the female terminal 132 as one can take from e.g. FIG. 4.

Accordingly, the protruding ribs 216 do not extend into the second cavity portion 214 since they would possibly interfere with any parts of a corresponding female terminal 300 that is housed in the cavity 210. A circular cross section may be of advantage for a facilitated production (molding) process. Since the bottom housing 200 is usually produced in a one-piece design using the same material, comparable material parameters (e.g. rigidity, resistivity) apply for all locations along the inner surface of the cavity, allowing a facilitated estimation of the behavior of the connector.

FIG. 3 depicts the corresponding female terminal 300, designed to fit in the cavity 210. It comprises a first terminal portion 310 and a second terminal portion 320. Both terminal portions are aligned along the mating direction 600 and a terminal step 330 is provided or formed at the position where the two portions merge with each other. The first terminal portion 310 has a cylindrical cross section and a length along mating direction 600 that is small compared to the length of the second terminal portion 320. The second terminal portion 136 comprises two spring arms 322 extending in mating direction 600 for engagement with a corresponding male terminal. Additionally, locations 312 are marked, where the protruding ribs 216 engage the female terminal 300 in mounted condition (see FIG. 4). Hence, the lengths of the protruding ribs 216 and the first cavity portion 212 correspond to the "guiding length", that is the length of the first terminal portion 310 which is in contact with the inner walls of the first cavity portion 212. The two spring arms 322 narrow from the terminal step 330 towards their distal ends, i.e. towards the mounting end 220. Further, each of the two spring arms 322 is flexibly attached to the terminal step 330, so that it is able to bend outwards up to a certain degree in a reversible manner. At the distal end, the two spring arms 322 comprise a tulip-shaped mating end 324, which allow to grab and align entering pins 152 even under bad conditions, e.g. in a very inclined way. Opposite to the tulip-shaped mating end 324, there is an electrical collector 340 attached on the top of the first terminal portion 310. The electrical collector 340 serves for electrical connection of the female terminal 132 with a signal wire.

Figure 4:
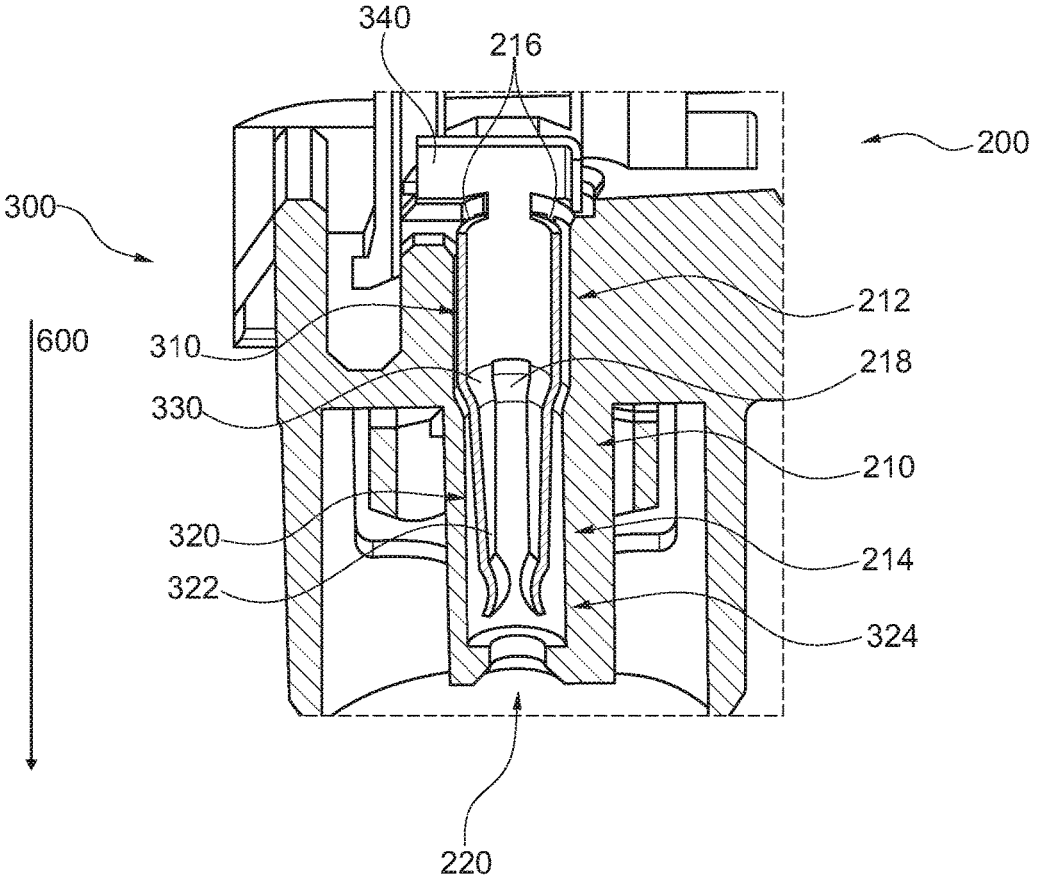
FIG. 4 illustrates the detail of the housing as already shown in FIG. 2 with a female contact terminal, as shown in FIG. 3, mounted inside the cavity according to one embodiment of the invention.

FIG. 4 depicts a sectional view of the bottom housing 200 comprising the cavity 210 in mounted condition. The female terminal 300 is located inside the cavity 210, such that the cavity step 218 and terminal step 330 of the cavity 210 and the female terminal 300 engage each other. Protruding ribs 216 are depicted which extend from the cavity step 218 parallel to the mating direction 600 to the top side of the first cavity portion 212. The ribs are designed in a way that they do not come into contact with the edge of the terminal step 330 during the assembly of the female terminal 300 within the cavity 210. Since the female terminal 300 is inserted from the top side (as seen from the orientation shown in FIG. 4), the edge of the terminal step 330 could possibly damage the protruding ribs 216 when brought downwards in mating direction 600. Accordingly, the protruding ribs 216 have to be dimensioned and located in a way that they are not damaged during assembly.

The first terminal portion 310 is located in the first cavity portion 212 and comprises a cylindrical shape with a circular cross section. The respective dimensions of first terminal portion 310 and first cavity portion 126 are chosen such that the first terminal portion 310 is snugly held in the first cavity portion 212. The length of the first terminal portion 310 corresponds to a "guiding length" that is smaller, compared the length of the second terminal portion 320. The reduction of guiding length is possible due to the increased stability, caused by the engagement of the steps of the female terminal 300 and cavity 210 and the additional clamping of the female terminal 300 by the protruding ribs 216. The two spring arms 322 of the second terminal portion 320 are housed in the second cavity portion 214, which comprises a smaller diameter D2 than the first cavity portion 126.

On top of the first terminal portion 310, an electrical collector 340 is attached for tapping the electric current from the female terminal 300, and for transferring it by means of a wire or cable further through and out of the connector. As can be seen in FIG. 4, the electrical collector 340 is mechanically stabilized by guiding means, which are integrally formed on the upper side of the bottom housing 200. This leads to additional mechanical stabilization of the female terminal 300 preventing the terminal from any unwanted movements during cable pull or during the mating/unmating of the connector.

Figure 5:
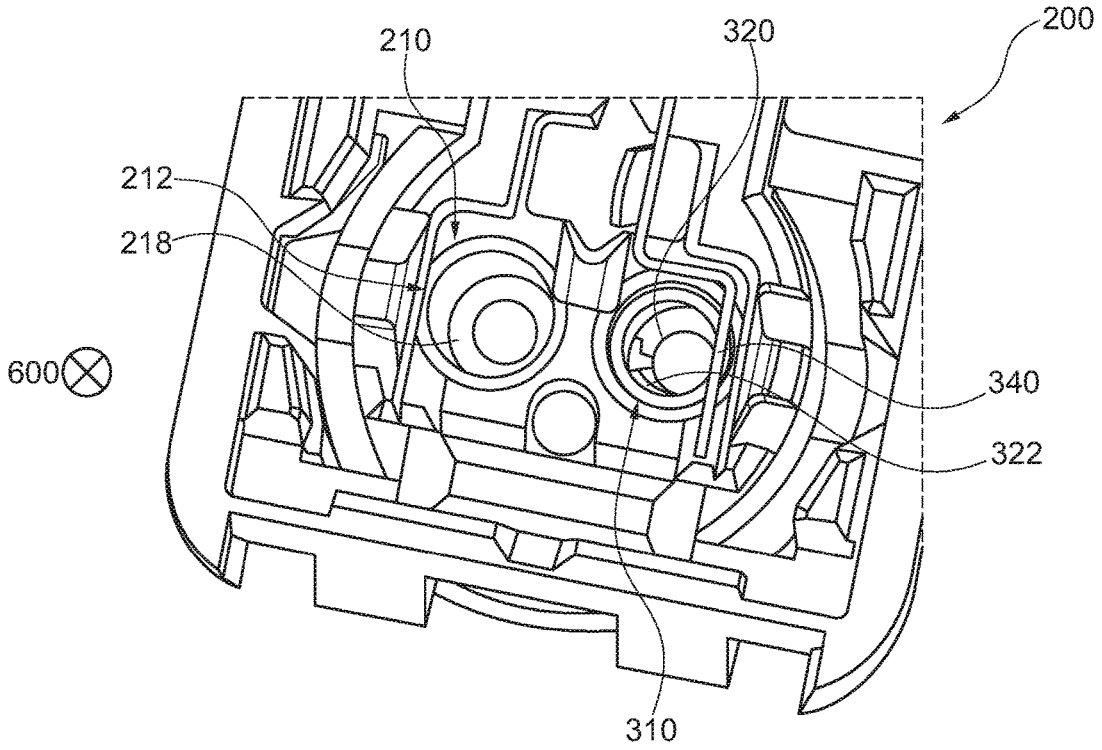
FIG. 5 illustrates a top view of the female bottom housing in mounted and un-mounted conditions according to one embodiment of the invention.

FIG. 5 depicts a top view of the bottom housing 200. One can see the two cavities 210, whereby on the left-hand side no terminal is yet mounted and on the right-hand side a female terminal 300 is mounted. The two cavities 210 are cylindrical and reveal a circular cross section. In the unmounted condition, the first cavity portion 212 is depicted with a total of four protruding ribs 216, integrally formed with the inner walls of the first cavity portion 212. All protruding ribs 216 are equally distributed along the circumference of the inner wall of the first cavity portion 212. In mounted condition the protruding ribs 216 additionally clamp and thus fix the female terminal 300 inside the cavity 210, as indicated on the right-hand side. Due to the equal distribution, the ribs at the same time provide an accurate centering of the terminal inside the cavity. As can be seen in this top view, also the first terminal portion 310 comprises circular cross section.

While this invention has been described in terms of the preferred embodiments thereof, it is not intended to be so limited, but rather only to the extent set forth in the claims that follow. Moreover, the use of the terms first, second, primary secondary, etc. does not denote any order of importance, but rather the terms first, second, etc. are used to distinguish one element from another. Furthermore, the use of the terms a, an, etc. do not denote a limitation of quantity, but rather denote the presence of at least one of the referenced items.

We claim:

1. An electrical connector configured to be mated with a corresponding counter connector to establish an electrical connection, said electrical connector comprising:

a connector housing having a terminal cavity for receiving a female contact terminal, wherein the terminal cavity defines a cylindrical first cavity portion having a first diameter and a cylindrical second cavity portion having a second diameter smaller than the first diameter both extending coaxially and in a mating direction, and wherein the terminal cavity defines a first tapered portion between the first and the second cavity portions; and a female contact terminal having a cylindrical first terminal portion having a third diameter configured to fit within the first cavity portion and a second terminal portion configured to receive a corresponding male pin and having a fourth diameter smaller than the third diameter and configured to fit within the second cavity portion, wherein the female contact terminal defines a second tapered portion between the first and second terminal portions such that the first tapered portion and the second tapered portion engage each other in a fully mounted condition.

2. The electrical connector according to claim 1, wherein the first terminal portion is arranged in the first cavity portion and the first and second tapered portions prevent a movement of the female contact terminal in the mating direction.

3. The electrical connector according to claim 1, wherein inner walls of the terminal cavity comprise a protruding rib extending parallel to the mating direction.

4. The electrical connector according to claim 3, wherein the inner walls of the terminal cavity comprise at least two protruding ribs extending parallel to the mating direction and wherein the at least two protruding ribs are equidistant from their respective neighboring ribs along a circumference of an inner surface of the first cavity portion.

5. The electrical connector according to claim 3, wherein the inner walls of the terminal cavity comprise at least protruding three ribs extending parallel to the mating direction.

6. The electrical connector according to claim 3, wherein the protruding rib is integrally formed with the inner walls of the terminal cavity.

7. The electrical connector according to claim 3, wherein the protruding rib extends for at least 50% of a length of the first terminal portion in the mating direction.

8. The electrical connector according to claim 3, wherein the protruding rib is formed such that the protruding rib clamps the first terminal portion in the first cavity portion in the mounted condition.

9. The electrical connector according claim 1, wherein a length of the first cavity portion in the mating direction is less than a length of the second cavity portion in the mating direction.

10. The electrical connector according claim 1, wherein a length of the first terminal portion in the mating direction is less than a length of the second terminal portion in the mating direction.

11. The electrical connector according claim 1, wherein the second terminal portion comprises two spring arms extending in the mating direction, wherein proximal ends of the two spring arms merge with the second tapered portion of the female contact terminal.

12. The electrical connector according claim 11, wherein the two spring arms comprise a tulip shape at a distal end.

13. The electrical connector according claim 1, wherein the female contact terminal is designed to mate with a male pin having a diameter of 0.2 to 3 mm.

14. The electrical connector according claim 1, wherein the electrical connector is a supplemental restraint system connector.

15. The electrical connector according claim 1, wherein the first and second cavity portions are cylindrical with a circular cross section and a diameter of the first cavity portion is larger than a diameter of the second cavity portion and wherein the first tapered portion is provided at a position where the two cylindrical portions merge with each other.

16. The electrical connector according claim 1, wherein the first terminal portion is cylindrical with a circular cross section, and the second terminal portion comprises two spring arms extending in the mating direction for engagement with a corresponding male terminal and wherein the second tapered portion is provided at a position where the first and second terminal portions merge with each other.

* * * * *